US006645449B2

(12) United States Patent
Rollinger

(10) Patent No.: US 6,645,449 B2
(45) Date of Patent: Nov. 11, 2003

(54) METHOD FOR ELIMINATING HALOGENATED AND NON-HALOGENATED WASTE

(75) Inventor: Guy Rollinger, Wickrange (LU)

(73) Assignee: Pac Holding S.A., Wickrange (LU)

( * ) Notice: Subject to any disclaimer, the term of this patent is extended or adjusted under 35 U.S.C. 154(b) by 0 days.

(21) Appl. No.: 09/463,349

(22) PCT Filed: Jul. 20, 1998

(86) PCT No.: PCT/EP98/04508

§ 371 (c)(1),
(2), (4) Date: Nov. 30, 2000

(87) PCT Pub. No.: WO99/04861

PCT Pub. Date: Feb. 4, 1999

(65) Prior Publication Data

US 2003/0149325 A1 Aug. 7, 2003

(30) Foreign Application Priority Data

Jul. 23, 1997 (LU) ..... 90109
Dec. 24, 1997 (LU) ..... 90191

(51) Int. Cl.[7] ..... A62D 3/00
(52) U.S. Cl. ..... 423/240 S; 588/205

(58) Field of Search ..... 588/205, 206, 588/207, 210, 212, 213, 227, 228, 248; 423/240 R, 240 S

(56) References Cited

U.S. PATENT DOCUMENTS

| | | | | | |
|---|---|---|---|---|---|
| 4,317,800 | A | * | 3/1982 | Sloterdijk et al. | 423/1 |
| 4,435,379 | A | | 3/1984 | Olson | |
| 4,541,907 | A | | 9/1985 | Culleiton | |
| 5,118,492 | A | | 6/1992 | Okazaki | |
| 5,222,448 | A | * | 6/1993 | Morgenthaler et al. | 110/346 |
| 5,280,757 | A | * | 1/1994 | Carter et al. | 110/346 |
| 5,608,136 | A | * | 3/1997 | Maezawa et al. | 588/228 |

FOREIGN PATENT DOCUMENTS

| | | |
|---|---|---|
| CA | 2168924 | 2/1996 |
| EP | 0 208 592 | 1/1987 |
| EP | 0 252 521 | 1/1988 |
| EP | 0 306 540 | 3/1989 |

* cited by examiner

*Primary Examiner*—Stanley S. Silverman
*Assistant Examiner*—Edward M. Johnson
(74) *Attorney, Agent, or Firm*—Smith, Gambrell & Russell

(57) ABSTRACT

A method for eliminating halogenated and non halogenated waste, whereby waste is reacted with products containing metal oxide in an oxygen-free medium at temperatures ranging from 800° C. to 1100° C.

39 Claims, 1 Drawing Sheet

METHOD FOR ELIMINATING HALOGENATED AND NON-HALOGENATED WASTE

The present invention relates to a process for disposing of halogenated and non-halogenated waste substances.

Substituted, in particular halogenated hydrocarbons, such as are present for example in carbon tetrachloride, chloroform, methylene chloride, tetra- and trichloroethylene, tetrachloroethane, PCB etc., but also in PVC or polyvinylidene chloride, are a more or less problematical toxic or special waste following use, which has to be disposed of.

Substances with a strong toxic effect on the environment and man, such as halogenated compounds, in particular polyhalogenated substances such as PCBs or TCDD/TCDF (dioxins/furans) cannot be automatically recycled and have to be disposed of in an environmentally friendly manner.

The disposal takes place either by dumping or by incineration on the high seas or else on land in high-temperature furnaces with an excess of air.

The energy requirement is in many cases not inconsiderable, since not only do the substances to be disposed of have to be vaporised and heated to the required decomposition temperature, but enormous amounts of air also have to be heated up. In so doing either, as with incineration on the high seas, pollution of the atmosphere and the risk of acid rain have to be allowed for, or extremely expensive plants are required for keeping the air clean.

There is known from DE-A-33 13 889 a process or an apparatus for disposing of toxic and special waste, in which the toxic waste substances are mixed with an electrically conductive material, in particular in the form of iron powder and/or coke, and are brought in an induction furnace to the decomposition temperature of the toxic and/or special waste to be eliminated.

U.S. Pat. No. 4,435,379 discloses a process for decomposing chlorinated hydrocarbons with metal oxides with the aim of converting all carbon atoms into carbon monoxide. It is a question here of providing elemental chlorine for the conversion of hydrogen groups into HCl. The overall ratio of chlorine to hydrogen groups must be at least 1:1 here, in order to be able to produce metal chloride.

U.S. Pat. No. 4,587,116 discloses a similar process, in which nitrogen-containing waste substances can also be disposed of. The heating likewise takes place from the outside and not from the inside.

EP-0 306 540 discloses a process for recovering energy from substituted hydrocarbons such as are present e.g. as $CCl_4$, $CHCl_3$, $C_2H_2Cl_4$, PCB, PVC, polyvinylidene chloride etc. in pure or bound form. In this process the waste material is decomposed thermally in an inductively heated reactor in the presence of a barely treatable metal oxide and an electrically conductive material, for example electrode coke or electrographite, and in contact with water vapour at temperatures of between 800 and 1100° C. A portion of the metal oxide that corresponds to the chloride content of the waste materials is there converted into volatile metal chloride. A portion of the liberated carbon is converted into carbon monoxide and the portion of the carbon not reacting on the metal oxide is converted to water gas ($CO+H_2$) with the aid of a stoichiometric amount of water vapour.

It is the object of the present invention to develop a process which makes it possible to dispose of various halogenated and non-halogenated waste materials in an environmentally friendly manner.

This object is achieved according to the invention by a process for disposing of halogenated and non-halogenated waste materials in which the halogenated and non-halogenated waste materials are reacted with metal oxide-containing products with the exclusion of oxygen at temperatures of 800° C. to 1100° C.

The process described here can be used for the environmentally neutral recycling of halogenated and non-halogenated waste materials.

The volume of the wastes used is largely reduced, so that as few residues as possible remain and as large a quantity as possible of metals/metal compounds is obtained. As positive an energy balance as possible is aimed at during the reaction.

In a preferred embodiment of the process, carbon-containing halogenated waste materials are reacted.

In an advantageous embodiment of the process, carbon dioxide is added as a fluidising gas.

Furthermore the reactor can also be supplied with carbon in the form of graphite and/or coal.

In a preferred manner a halogenatable metal oxide-containing product is used as a metal oxide-containing educt.

In a specific embodiment variant of the process according to the invention products which contain CaO, $TiO_2$, $SiO_2$, $Al_2O_3$ and/or $Fe_2O_3$ or a mixture thereof are used as halogenatable, metal oxide-containing reactants.

Various metal-oxide containing waste materials, such as silicon-containing residues from the metal-working industry, filter dusts, flue ashes, wind-blown sands, waste dumps, galvanic sludges, slags, slate residues etc., can also serve as reactants. Simple quartz, which consists about 98% of silicon dioxide ($SiO_2$), is the simplest possible material which can be use for the conversion.

All of the above-mentioned materials are characterised by the fact that they contain a relatively high content of halogenatable metal oxides (CaO, $SiO_2$, $TiO_2$, $Al_2O_3$, $Fe_2O_3$ etc.

This has the resultant advantage that materials containing metal oxides not treatable with economic agents to date now acquire a useful application.

Solvents such as carbon tetrachloride, chloroform, methylene chloride, tetra- and trichloroethylene, tetrachloroethane, coolants or refrigerants, PCB, pesticides, fungicides and herbicides, halogenated plastics such as PVC can be used as halogenated waste materials.

A portion of the metal oxide that corresponds to the chlorine content of the waste materials is converted into metal chloride by the above-mentioned process. Ecologically and economically useful metal chlorides are obtained, wherein silicon and titanium tetrachloride ($SiCl_4$, $TiCl_4$,) represent particularly preferred products.

Other materials such as spent oils, lubricants, fats, paints, dyes, tars, waxes, plastics, coolants and solvents, brake fluid or similar non-halogenated substances and materials can also be disposed of.

The reaction or conversion products preferably formed thermodynamically under these process parameters are hydrogen ($H_2$), which primarily occurs in gaseous form, together with smaller volumes in percentage terms of methane ($CH_4$).

The formation of environmentally dangerous or environmentally polluting, gaseous substances such as carbon monoxide (CO), as well as the carbon dioxide ($CO_2$) known as a so-called greenhouse gas, is, under the preferred reaction conditions, negligibly small. Only at temperatures above 1100° C. can CO or $CO_2$ be formed by chemical decomposition processes.

The conversion takes place in a fluidised bed reactor. The latter can be constructed either from special ceramics, silicon carbide (SiC) or specially alloyed steels.

The reactor can be brought to the required operating temperatures either by the use of electric heating elements (e.g. heating half-shells) or by the use of an induction heater. The temperatures required for the conversion lie in the range from 800° C. to 1100° C. The reaction itself takes place with the exclusion of oxygen. Carbon dioxide ($CO_2$) is used as the fluidising gas.

The halogenated compounds are decomposed into their simplest constituents by the high temperatures. In the case of chlorinated hydrocarbons, hydrogen chloride, hydrogen, alkanes and chlorine gas are formed. The chlorine gas and the hydrogen chloride serve as chlorinating agents for the metal oxide-containing products or wastes. Products of this chlorinating reaction are the thermodynamically preferred metal chlorides.

In addition to the chlorides, hydrogen and carbon monoxide are formed, which can be used as a synthesis gas either for the obtaining of electrical energy or for other chemical syntheses, for example the methanol synthesis.

$$2H_2+CO=CH_3OH \qquad \text{Reaction equation}$$

The carbon dioxide ($CO_2$) used as the fluidising gas is converted completely to carbon monoxide (CO) by reaction with the carbon of the decomposed hydrocarbons and by an additional coal or graphite charge in the top part of the reactor.

The so-called BOUDOUARD reaction is referred to in this context:

$$CO_2+C=2CO \qquad \text{Reaction equation 2}$$

The formation of environmentally harmful compounds such as dioxins, furans or e.g. phosgene ($COCl_2$) is extremely improbable under the prevailing reaction conditions.

All the halogenated metal compounds produced are present initially in gaseous form. Depending on the starting material, solid, i.e. crystalline metal compounds can be obtained by cooling to room temperature, or else liquid metal compounds by condensation at low temperatures.

The degree of purity of these compounds is around 96% and can be further improved e.g. by a fractionating distillation, also called rectification.

Various embodiments of the invention will now be described below by means of the attached figure, where

BRIEF DESCRIPTION OF THE DRAWING

The FIGURE shows a diagram of the plant for disposing of halogenated waste materials.

In the diagrammatic flow-chart of the process, as shown in the FIGURE, a feed line 1 for the halogenated waste materials, a feed line 2 for metal oxide-containing products, and a line 3 for the discharge of unconverted materials 3 can be seen. A fluidising gas ($CO_2$) is blown into the fluidised bed reactor 5 via a feed unit 4.

Figure 1:
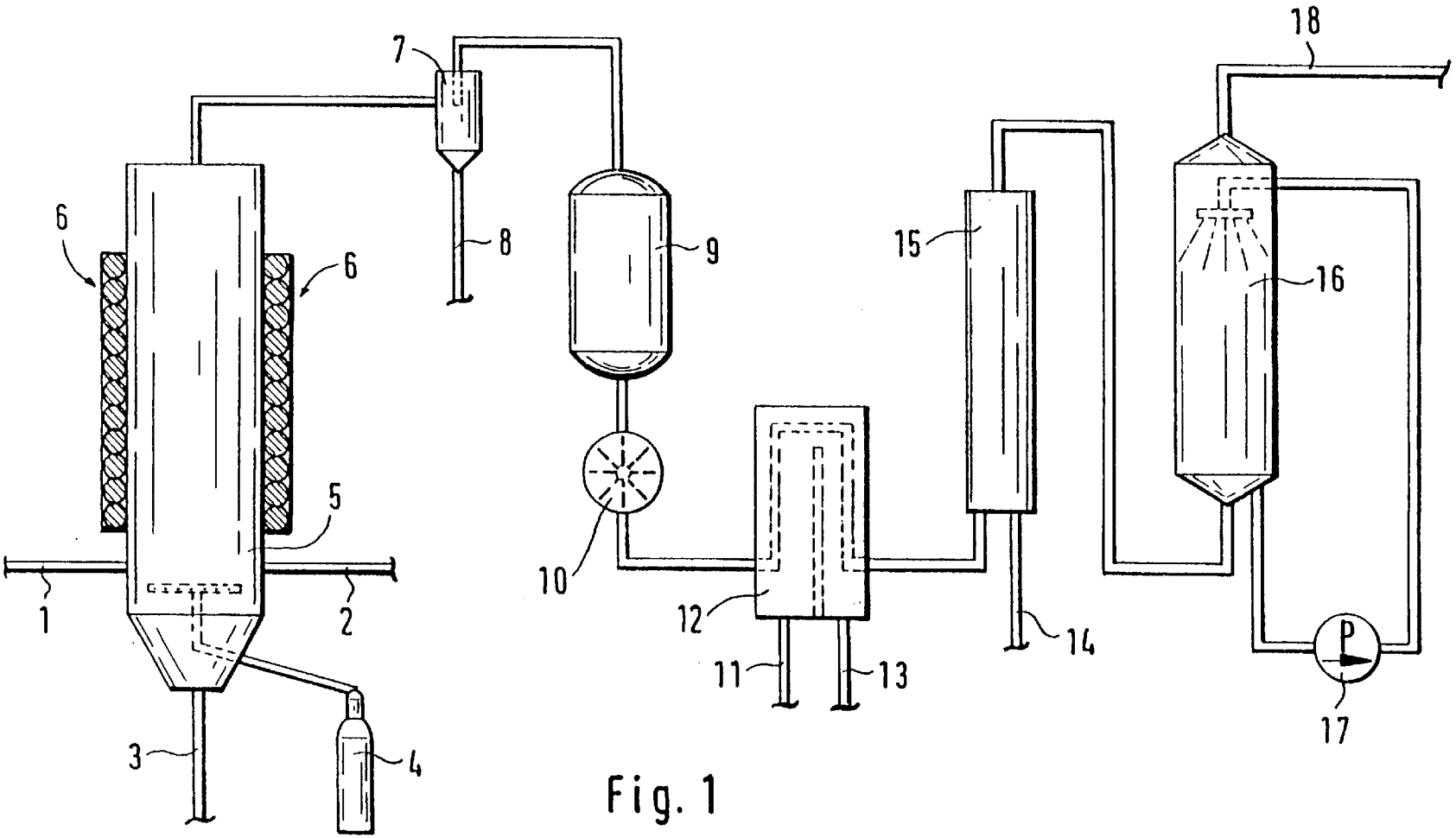

The reactor 5 is heated by means of a reactor heater 6 to a temperature of between 800° C. and 1100C., so that a reaction between the halogenated waste materials and the metal oxide-containing materials takes place in the reactor. The products formed are separated in a solids trap 7, and the solid metal chlorides formed, in particular $AlCl_3$ and $FeCl_3$, are discharged via a line 8. The remaining gases are purified by an activated carbon filter 9 and then compressed by a fan 10. The gases are then cooled in a cooling tank 12, which comprises a coolant inlet 11 and a coolant outlet 13, so that the remaining metal chlorides are separated out. $SiCl_4$ is mainly involved here.

The gases are then fed to a condenser 15 and subjected to an alkaline gas scrubbing in a gas scrubbing column 16. The column 16 possesses a circulating pump 17 for the scrubbing fluid. The remaining synthesis gas, a mixture of CO and $H_2$, is discharged through the line 18 in the upper part of the gas scrubbing column 16.

The disposal of perchloroethylene ($C_2Cl_4$) and vinyl chloride ($C_2H_3Cl$, a monomer of polyvinyl chloride) as halogenated waste materials may be cited as an example of practical application. The conversion takes place with slate wastes from slate production as the metal oxide-containing product.

TABLE 1

Slate analysis from Martelange, Belgian-Luxembourg border region

| Compound | Share in per cent (% w/w) |
|---|---|
| $SiO_2$ | 59.1 |
| $Al_2O_3$ | 19.8 |
| $Fe_2O_3$ | 8.2 |
| $Na_2O$ | 2.5 |
| CaO | 2.4 |
| $K_2O$ | 3.3 |
| MgO | 3.2 |
| $FeS_2$ | 0.5 |
| C | 1 |

Prior to the processing the slate wastes are reduced in size by means of a jaw crusher. Mean grain sizes in the range from 3–8 mm are advantageous.

APPLICATION EXAMPLE 1

Disposal of PER

The ground slate can be introduced into the reactor by injection together with the fluidising gas carbon dioxide ($CO_2$). A further supply of fluidising gas serves for the production and maintenance of the fluidised bed. An amount of about 20–27 $m^3$ of $CO_2$ is supplied per hour as fluidising gas.

The temperature of the fluidising gas is with advantage brought to about 500° C. Perchloroethylene ($C_2Cl_4$, PER) is used as the halogenated waste product. The PER is introduced as a sort of aerosol by a fluidising gas sub-flow directly into the reaction zone of the reactor. The PER is there decomposed into its constituents. The difference between PER and other solvents is that no hydrogen atoms are present in the molecule. The formation of hydrochloric acid (HCl) is therefore not possible.

Chlorine gas ($Cl_2$) is nevertheless formed, which is an outstanding chlorinating agent. The chlorine gas therefore reacts in the fluidised bed with the metal oxides of the slate to form metal chlorides (in general $Me_xCl_y$). Thus aluminum chloride ($AlCl_3$), iron-III-chloride ($FeCl_3$) and silicon tetrachloride ($SiCl_4$) can be formed.

The elemental carbon (C) occurring during the thermal decomposition of the chlorinated hydrocarbons reacts either with the fluidising gas ($CO_2$) or with the bound oxygen of the metal oxides with the formation of carbon monoxide.

Reaction equation 3 describes the chlorination of silicon dioxide with the formation of silicon tetrachloride and carbon monoxide.

$$SiO_2+C_2Cl_4=SiCl_4+2CO \qquad \text{Reaction equation 3}$$

The following equation applies in general to the disposal of PER with slate:

$$SiO_2+2Al_2O_3+2Fe_2O_3+7C_2Cl_4=SiCl_4+4AlCl_3+4FeCl_314CO \qquad \text{Reaction equation 4}$$

It becomes clear from reaction equation 4 that in addition to carbon monoxide various metal chlorides are formed. All the materials occur in gaseous form, initially at temperatures of about 1000° C. Directly downstream of the reactor the gases cool down very rapidly to about 800° C. due to the ambient air.

The use of separation units such as cyclones or activated carbon filters enables metal chlorides occurring in dusty or crystalline form, but mainly aluminum chloride and iron chloride, to be separated from the process gas flow and retained. The gas flow, supported by a fan, is aspirated through the filters. The result of this is that a slight vacuum can be noticed already at the reactor outlet, which lies in the range from about 0.01 to 0.05 bar below standard pressure.

The residual gases contain gaseous silicon tetrachloride and carbon monoxide. Since the silicon tetrachloride passes into the solid state at temperatures below −68° C., the process gas has to be cooled to temperatures of about −50° C. This takes place by a pre-cooling with liquid nitrogen and a subsequent cooling by means of a low-temperature mixture in a condensation column. The low-temperature mixture used is an acetone-dry ice mixture, which can generate temperatures down to not more than −86° C.

The silicon tetrachloride present in gaseous form is deposited in the condenser at the above-mentioned temperatures and is collected in a storage tank. The degree of purity of the condensed silicon tetrachloride is about 96%. Any foreign substances present can be removed by a subsequent fractionated distillation. The result of the purification by distillation would be a silicon tetrachloride solution with a degree of purity of approx. 99%.

After the condensation the process gas is subjected to an alkaline gas scrubbing with a 10% potassium hydroxide solution according to the counter-flow principle. The gas purified in this way then contains only carbon monoxide.

APPLICATION EXAMPLE 2

Disposal of Vinyl Chloride

The process engineering layout of the plant corresponds to the layout that has also been used for the disposal of perchloroethylene (PER). The underlying chemical reactions are described below.

During the reacting of vinyl chloride ($C_2H_3Cl$), as a monomer of polyvinyl chloride (PVC), with slate wastes the following chemical reactions occur, for example:

$$SiO_2+4C_2H_3Cl+6CO_2=SiCl_4+6H_2+14CO \qquad \text{Reaction equation 5}$$

$$Al_2O_3+6C_2H_3Cl+9CO_2=2AlCl_3+9H_2+21CO \qquad \text{Reaction equation 6}$$

$$Fe_2O_3+6C_2H_3Cl+9CO_2=2FeCl_3+9H_2+21CO \qquad \text{Reaction equation 7}$$

There is therefore obtained as the total reaction equation:

$$SiO_2+Al_2O_3+Fe_2O_3+16C_2H_3Cl+24CO_2=SiCl_4+2AlCl_3+2FeCl_3+24H_2+56CO \qquad \text{Reaction equation 8}$$

The process engineering separation of the aluminum and the iron chloride ($AlCl_3$, $FeCl_3$) takes place on the one hand by centrifugal force deposition in a cyclone and on the other by deposition in special filters. The separation of the silicon tetrachloride takes place in the manner already described.

It is obvious from reaction equation 8 that in addition to the metal chlorides a synthesis gas consisting of carbon monoxide and hydrogen is formed. The ratio between hydrogen and carbon monoxide is 1:2.3. A so-called synthesis gas is spoken of here, which has many technical uses.

APPLICATION EXAMPLE 3

Disposal of Hydrocarbon- (HC) or Halogenated Hydrocarbon-containing (HHC) Wastes in the Presence of Calcium Oxide The various feedstocks, such as inter alia oils, fats, PCBs, CFCs, solvents or similar are conveyed via a metering device, e.g. an eccentric screw pump, into the reaction zone. There a first thermal cleavage of the feedstocks into short-chain hydrocarbons takes place very rapidly. The residence time of the feedstocks or that of the cleavage products obtained is determined by the height of the reaction zone.

As a rule a virtually quantitative breakdown into substantially hydrogen and methane takes place, wherein the volume ratio of hydrogen to methane lies clearly on the side of the hydrogen. Since the melting point of calcium oxide (CaO) is around 2500° C., substantial amounts of synthesised calcium compounds do not have to be allowed for.

If on the other hand halogenated feedstocks, in particular chlorinated materials, are caused to react, a reaction between the calcium oxide and the halogen atoms of the feedstocks then occurs.

In the main calcium chloride ($CaCl_2$) is formed as the reaction product, which remains in the reactor as slag or melt. The following reaction equation (reaction equation 1) takes account of all the main products which are formed during the disposal or recycling of a halogenated hydrocarbon. The individual products have been calculated thermodynamically and attested experimentally.

$$2CaO+4C_2H_5Cl=2CaCl_2+2CO+CH_4+5C+8H_2 \qquad \text{Reaction equation 9}$$

In addition to this reaction, carbon in the form of fine soot particles is also discharged out of the reactor.

The separation from the remaining gaseous constituents hydrogen and methane, or hydrogen and carbon monoxide (CO), is carried out by gravity separators, such as a high-capacity cyclone.

The gases cleaned in this way can in the interests of safety also be passed through activated carbon filters. Should foreign constituents still be contained in the process gas, the latter can be removed either by targeted condensation or by a gas scrubbing.

Finally, there remains as a rule only one synthesis gas, consisting of carbon monoxide, methane and hydrogen, which can be used for many different technical applications, e.g. energy recovery or use for chemical syntheses (methanol synthesis).

What is claimed is:

1. A process for disposing of halogenated and non-halogenated waste materials, comprising chemically reacting the waste materials with at least one or $TiO_2$, $SiO_2$, CaO and $Fe_2O_3$ while excluding oxygen at temperatures of 800° C. to 1100° C.

2. The process according to claim 1, wherein the waste materials contain carbon.

3. The process according to claim 1, wherein carbon dioxide is added during the process.

4. The process according to claim 1, wherein carbon is added during the process.

5. The process according to claim 4, wherein said carbon is graphite and/or coal.

6. The process according to claim 1, wherein the halogenated waste material is selected from the group consisting of solvents, carbon tetrachloride, chloroform, methylene chloride, tetrachloroethylene trichloroethylene, tetrachloroethane, coolants, refrigerants, PCB, pesticides, fungicides, herbicides, halogenated plastics, PVC and mixtures thereof.

7. The process according to claim 1, wherein a portion of a metal oxide that corresponds to a chlorine content of the waste materials is converted into metal chloride.

8. The process according to claim 1, wherein the non-halogenated waste material is selected from the group consisting of spent oils, lubricants, fats, paints, dyes, tars, waxes, plastics, coolants, solvents, brake fluid and mixtures thereof.

9. The process according to claim 1, wherein a first feed line feeds in the halogenated waste material to a reactor and a second line feeds in a product containing metal oxides to said reactor.

10. The process according to claim 9, wherein said product containing metal oxides is fed to the reactor in granulated form with a mean grain size of 3–8 mm.

11. The process according to claim 10, wherein said product containing metal oxides is slate.

12. The process according to claim 11, wherein the slate is introduced into the reactor apart from perchloroethylene as the halogenated waste material which is also introduced into the reactor.

13. A process for disposing of halogenated and non-halogenated waste materials, comprising chemically reacting in a reaction the waste materials with a product containing metal oxides, wherein the metal oxides that are playing an active part in the reaction are at least one of $TiO_2$, $SiO_2$, CaO and $Fe_2O_3$, mid with the reaction being carried out with an exclusion of oxygen at temperatures of 800° C. to 1100° C. in a reactor.

14. The process according to claim 13, wherein a first feed line feeds in halogenated waste material to a reactor and a second line feeds in the product containing metal oxides to said reactor.

15. The process according to claim 13, wherein said product containing metal oxides is fed in granulated form with a mean grain size of 3–8 mm.

16. The process according to claim 13, wherein said product containing metal oxides is slate.

17. The process according to claim 16 wherein ground slate is introduced into a reactor apart from perchloroethylene as the halogenated waste material which is also introduced into the reactor.

18. A process for disposing of halogenated and non-halogenated carbon-containing waste materials, comprising:

reacting the waste material with metal-oxide containing products with an exclusion of oxygen at temperatures of 800° C. to 1100° C., and wherein carbon dioxide is added during the process, wherein the waste materials and metal-oxide containing products are introduced into a fluidized bed reactor and the added carbon dioxide is introduced as a fluidizing gas for the fluidized bed reactor, and wherein the carbon dioxide used as the fluidizing gas is converted completely to carbon monoxide by reaction with carbon of decomposed hydrocarbons in the fluidized bed reactor and by an addition of additional carbon material.

19. The process of claim 18 wherein the additional carbon material is coal, graphite, or both.

20. The process according to claim 18, wherein the halogenated waste material is selected from the group consisting of solvents, carbon tetrachloride, chloroform, methylene chloride, tetrachloroethylene, trichloroethylene, tetrachloroethane, coolants, refrigerants, PCB, pesticides, fungicides, herbicides, halogenated plastics, PVC and mixtures thereof.

21. The process according to claim 18, wherein a portion of a metal oxide that corresponds to a chlorine content of the waste materials is converted into metal chloride.

22. The process according to claim 18, wherein the non-halogenated waste material is selected from the group consisting of spent oils, lubricants, fats, paints, dyes, tars, waxes, plastics, coolants, solvents, brake fluid and mixtures thereof.

23. The process according to claim 18, wherein a first feed line feeds in the halogenated waste material to the reactor and a second line feeds in a product containing metal oxides to the reactor.

24. The process according to claim 23, wherein said product containing metal oxides is fed to the reactor in granulated form with a mean grain size of 3–8 mm.

25. The process according to claim 23, wherein said product containing metal oxides is slate.

26. A process for disposing of halogenated and non-halogenated waste material, comprising:

introducing waste material comprising halogenated waste material to a reactor as a first reactant;

introducing a halogenatable, metal oxide material which is selected form the group consisting of CaO, $TiO_2$, $Al_2O_3$, $SiO_2$, $Fe_2O_3$, and mixtures thereof to the reactor as a second reactant;

chemically reacting the first and second reactants at a temperature of 800° C. to 1100° C. while excluding oxygen and with said second reactants being supplied in sufficient quantity for the introduced metal oxide material to act as a metal oxide containing adduct, and separating out, from reaction product gases produced in the reaction of the first and second reactants, halogenated metal compounds.

27. The process of claim 26, wherein the separating out of halogenated metal compounds includes cooling halogenated metal compounds initially in gaseous form to form solid, crystalline metal compounds.

28. The process of claim 27, wherein said cooling is carried at a location downstream from the reactor.

29. The process of claim 27, wherein the separating out of halogenated metal compounds occurs at a separation unit positioned downstream from the reactor.

30. The process of claim 29, wherein the separating out of halogenated metal compounds includes removal of metal chlorides while in solid form and suspended within a reaction product gas flow traveling downstream from said reactor.

31. The process of claim 26, wherein the separating out of halogenated metal compounds includes a first and a second separation stage with a first type of halogenated metal compound removed at the first stage and a second type of halogenated metal compound removed from the second stage.

32. The process of claim 26, wherein the separated out halogenated metal compound is a metal chloride.

33. The process of claim 26, wherein the separated out halogenated metal compound is subjected to further purification.

34. The process of claim 33, wherein further purification comprises distilling said halogenated metal compound.

35. The process of claim 26, wherein the separating out of halogenated metal compounds includes condensing halogenated metal compounds initially in gaseous form.

36. The process of claim 26, further comprising introducing carbon dioxide to the reactor during the reaction of the first and second reactants.

37. The process of claim 26, wherein the waste material is a carbon containing halogenated waste material.

38. A process for disposing of halogenated and non-halogenated waste material, comprising:

introducing waste material comprising halogenated waste material to a reactor as a first reactant;

introducing a halogenatable, metal oxide material which is selected form the group consisting of CaO, $TiO_2$, $Al_2O_3$, $SiO_2$, $Fe_2O_3$, and mixtures thereof to the reactor as a second reactant;

reacting the first and second reactants at a temperature of 800° C. to 1100° C. while excluding oxygen and with said second reactants being supplied in sufficient quantity for the introduced metal oxide material to act as a metal oxide containing adduct, and separating out, from reaction product gases produced in the reaction of the first and second reactants, halogenated metal compounds, wherein the separating out of halogenated metal compounds includes a first and a second separation stage with a first type of halogenated metal compound removed at the first stage and a second type of halogenated metal compound removed from the second stage, and wherein metal chlorides are removed at the first stage and $SiCl_4$ at the second stage.

39. A process for disposing of halogenated and non-halogenated waste material, comprising:

introducing waste material comprising halogenated waste material to a reactor as a first reactant;

introducing a halogenatable, metal oxide material which is selected form the group consisting of CaO, $TiO_2$, $Al_2O_3$, $SiO_2$, $Fe_2O_3$, and mixtures thereof to the reactor as a second reactant;

reacting the first and second reactants at a temperature of 800° C. to 1100° C. while excluding oxygen and with said second reactants being supplied in sufficient quantity for the introduced metal oxide material to act as a metal oxide containing adduct, and separating out, from reaction product gases produced in the reaction of the first and second reactants, halogenated metal compounds, wherein the separated out halogenated metal compound is subjected to further purification, and wherein further purification comprises distilling said halogenated metal compound.

* * * * *